US009474106B2

(12) United States Patent
Park

(10) Patent No.: US 9,474,106 B2
(45) Date of Patent: Oct. 18, 2016

(54) APPARATUS AND METHOD FOR CONTROLLING HEATING ELEMENT OF ELECTRIC RANGE

(71) Applicant: MUHAN DIGITAL Co., Ltd., Gimpo-si (KR)

(72) Inventor: Byoung-Goan Park, Seongnam (KR)

(73) Assignee: MUHAN DIGITAL CO., LTD. (KR)

( * ) Notice: Subject to any disclaimer, the term of this patent is extended or adjusted under 35 U.S.C. 154(b) by 324 days.

(21) Appl. No.: 14/344,412

(22) PCT Filed: Sep. 20, 2012

(86) PCT No.: PCT/KR2012/007547
§ 371 (c)(1),
(2) Date: Mar. 12, 2014

(87) PCT Pub. No.: WO2013/048061
PCT Pub. Date: Apr. 4, 2013

(65) Prior Publication Data

US 2014/0353304 A1 Dec. 4, 2014

(30) Foreign Application Priority Data

Sep. 30, 2011 (KR) ..... 10-2011-0099716

(51) Int. Cl.
*H05B 1/02* (2006.01)
*H05B 6/06* (2006.01)
*H05B 3/68* (2006.01)

(52) U.S. Cl.
CPC ..... *H05B 1/0266* (2013.01); *H05B 3/68* (2013.01); *H05B 6/065* (2013.01)

(58) Field of Classification Search
CPC .... H05B 1/0266; H05B 1/0263; H05B 3/68; H05B 6/065
USPC ..... 219/483, 485, 486, 412, 414, 497
See application file for complete search history.

(56) References Cited

U.S. PATENT DOCUMENTS 6,700,101 B2 * 3/2004 Decesari ..... F24C 7/087 219/443.1
7,041,940 B2 * 5/2006 Bakanowski ..... F24C 7/087 219/395
9,089,005 B2 * 7/2015 Boedicker ..... H05B 1/0263

FOREIGN PATENT DOCUMENTS

JP 2002190376 7/2002
JP 2003142247 5/2003
JP 2008147054 6/2008
JP 2008147055 6/2008

OTHER PUBLICATIONS

International Search Report—PCTKR2012/007547 dated Feb. 13, 2013.

* cited by examiner

*Primary Examiner* — Mark Paschall
(74) *Attorney, Agent, or Firm* — Cantor Colburn LLP

(57) ABSTRACT

Provided are an apparatus and method of controlling a heating element of an electric range. The apparatus for controlling a heating element of an electric range includes: a plurality of heating elements; an input unit to which an output adjustment value for each of the plurality of heating elements is input from a user; a calculation unit that calculates the sum of output power of each heating element corresponding to the output adjustment value input by the input unit; and a controller that compares the sum of output power calculated by the calculation unit with a predetermined power limit and linearly controls output of each heating element based on a result of comparison.

8 Claims, 3 Drawing Sheets

APPARATUS AND METHOD FOR CONTROLLING HEATING ELEMENT OF ELECTRIC RANGE

TECHNICAL FIELD

The present invention relates to an apparatus and method for controlling a heating element of an electric range, and more particularly, to an apparatus and method for controlling a heating element of an electric range, whereby, when a plurality of heating elements of the electric range are simultaneously used, power supplied to the electric range is controlled not to be over a limit.

BACKGROUND ART

The usage of apparatuses that use electricity is recently increasing in a real life. One of them is an electric range.

Electric ranges are cooking apparatuses that cook food using an electric heater or an additional heating element as a heat source. Electric ranges are classified into induction heaters using induction heating and radiant heaters using electrical resistance according to a heating method.

In the induction heater, a high frequency voltage having a predetermined magnitude is applied to a working coil as power is applied to the induction heater, such that a magnetic field is generated in the vicinity of the working coil. A magnetic force line of an induction magnetic field generated in this case causes an eddy current to be generated in a heating element, and the heating element is heated by the eddy current so that cooking can be performed.

Also, in the radiant heater, predetermined power is applied to a heating coil in a heating element, and high radiant heat is dissipated due to heating of the heating coil so that cooking can be performed.

Commonly, the electric range has a plurality of heating elements, wherein different outputs can be set to each of the plurality of heating elements. So, user can select heating elements suitable for kind, amount and usage of food.

Meanwhile, the heating element of the electric range has relatively high power consumption compared to other home appliances. When a plurality of heating elements are simultaneously used, power supplied to the electric range may be over a limit. In order to solve the problem, a method of dispersedly controlling the heating element of the electric range is used, whereby power supplied to at least one of the plurality of heating elements is blocked or power is alternately supplied to each of the heating elements for a predetermined amount of time so that power cannot be over the limit.

However, when the plurality of heating elements are simultaneously used, if power supplied to at least one of the heating elements is blocked or each of the heating elements is alternately controlled so that power of supply cannot be over the limit, heat that has been already heated is cooled again during a blocked time and thus, a heat loss occurs, and a time at which cooking is performed using the heating element, becomes long.

DETAILED DESCRIPTION OF THE INVENTION

Technical Problem

The present invention provides an apparatus and method for controlling a heating element of an electric range, whereby, even when a plurality of heating elements of the electric range are simultaneously used, power can be continuously supplied to each of the plurality of heating elements without completely blocking power supplied to each heating element and power supplied to the electric range can be controlled not to be over a limit.

Technical Solution

According to an aspect of the present invention, there is provided an apparatus for controlling a heating element of an electric range, the apparatus including: a plurality of heating elements; an input unit to which an output adjustment value for each of the plurality of heating elements is input from a user; a calculation unit that calculates the sum of output power of each heating element corresponding to the output adjustment value input by the input unit; and a controller that compares the sum of output power calculated by the calculation unit with a predetermined power limit and linearly controls output of each heating element based on a result of comparison.

When the sum of output power exceeds the power limit, the controller may divide a value that exceeds the power limit from the sum of output power according to a ratio of maximum output power of each heating element that is currently driven, among the plurality of heating elements and may down control output of each heating element that is currently driven corresponding to the divided value.

When the sum of output power exceeds the power limit, the controller may equally divide a value that exceeds the power limit from the sum of output power, into the number of each heating element that is currently driven among the plurality of heating elements and may down control output of each heating element that is currently driven corresponding to the divided value.

When the sum of output power exceeds the power limit, the controller may divide a value that exceeds the power limit from the sum of output power, based on a ratio of output power corresponding to the input output adjustment value versus maximum output power of each heating element and may down control output of each heating element corresponding to the divided value.

When the sum of output power exceeds the power limit, the controller may set a control order of each heating element according to a range of a value that exceeds the power limit from the sum of output power and may sequentially down control output of each heating element that is currently driven among the plurality of heating elements according to the set control order and the exceeding value.

The apparatus may further include a measurement unit that measures at least one of a current and a voltage applied to each heating element, wherein the calculation unit may calculate real power consumption of each heating element based on the at least one of the current and the voltage measured by the measurement unit.

When the sum of real power consumption of the plurality of heating elements is reduced over a set range compared to the sum of output power, the controller may up control output of each heating element that is currently driven among the plurality of heating elements based on a value reduced compared to the sum of output power.

The controller may compare the sum of real power consumption of the plurality of heating elements with the power limit and may up or down control output of each heating element that is currently driven among the plurality of heating elements according to a result of comparison.

When the sum of real power consumption of the plurality of heating elements is different from the power limit over the set range, the controller may divide the difference value according to a ratio of real power consumption of each heating element that is currently driven among the plurality of heating elements compared to the sum of real power consumption and may up or down control output of each heating element that is currently driven corresponding to the divided value.

When the sum of real power consumption of the plurality of heating elements is different from the power limit over the set range, the controller may up or down control output of each heating element that is currently driven among the plurality of heating elements according to the same ratio or a time unit value until the difference value is within the set range.

The apparatus may further include a measurement unit that measures temperature of each heating element, wherein the controller may compare the sum of output power with the power limit and linearly controls temperature of each heating element according to a result of comparison.

The apparatus may further include a display unit that displays at least one of output power, temperature, and a control state of each heating element.

According to another aspect of the present invention, there is provided a method of controlling a heating element of an electric range, whereby outputs of a plurality of heating elements of the electric range are controlled, the method including: inputting an output adjustment value for each of the plurality of heating elements from a user; calculating the sum of output power of each heating element corresponding to the input output adjustment value; comparing the calculated sum of output power with a predetermined power limit; and linearly controlling output of each heating element based on a result of comparison.

The linearly controlling of output of each heating element based on a result of comparison may include, when the sum of output power exceeds the power limit, dividing a value that exceeds the power limit from the sum of output power according to a ratio of maximum output power of each heating element that is currently driven, among the plurality of heating elements and down controlling output of each heating element that is currently driven corresponding to the divided value.

The linearly controlling of output of each heating element based on a result of comparison may include, when the sum of output power exceeds the power limit, equally dividing a value that exceeds the power limit from the sum of output power, into the number of each heating element that is currently driven among the plurality of heating elements and down controlling output of each heating element that is currently driven corresponding to the divided value.

The linearly controlling of output of each heating element based on a result of comparison may include, when the sum of output power exceeds the power limit, dividing a value that exceeds the power limit from the sum of output power, based on a ratio of output power corresponding to the input output adjustment value versus maximum output power of each heating element and down controlling output of each heating element corresponding to the divided value.

The linearly controlling of output of each heating element based on a result of comparison may include, when the sum of output power exceeds the power limit, setting a control order of each heating element according to a range of a value that exceeds the power limit from the sum of output power and sequentially down controlling output of each heating element that is currently driven among the plurality of heating elements according to the set control order and the exceeding value.

The method may further include: measuring at least one of a current and a voltage applied to each heating element; and calculating real power consumption of each heating element based on the at least one of the measured current and voltage.

The linearly controlling of output of each heating element based on a result of comparison may include, when the sum of real power consumption of the plurality of heating elements is reduced over a set range compared to the sum of output power, up controlling output of each heating element that is currently driven among the plurality of heating elements based on a value reduced compared to the sum of output power.

The linearly controlling of output of each heating element based on a result of comparison may include: comparing the sum of real power consumption of the plurality of heating elements with the power limit; and up or down controlling output of each heating element that is currently driven among the plurality of heating elements according to a result of comparison.

The up or down controlling of output of each heating element may include, when the sum of real power consumption of the plurality of heating elements is different from the power limit over the set range, dividing the difference value according to a ratio of real power consumption of each heating element that is currently driven among the plurality of heating elements compared to the sum of real power consumption and up or down controlling output of each heating element that is currently driven corresponding to the divided value.

The up or down controlling of output of each heating element may include, when the sum of real power consumption of the plurality of heating elements is different from the power limit over the set range, up or down controlling output of each heating element that is currently driven among the plurality of heating elements according to the same ratio or a time unit value until the difference value is within the set range.

The method may further include: measuring temperature of each heating element; and comparing the sum of output power with the power limit and linearly controlling temperature of each heating element according to a result of comparison.

The method may further include displaying at least one of output power, temperature, and a control state of each heating element.

MODE OF THE INVENTION

Hereinafter, the present invention will be described in detail by explaining exemplary embodiments of the invention with reference to the attached drawings.

Figure 1:
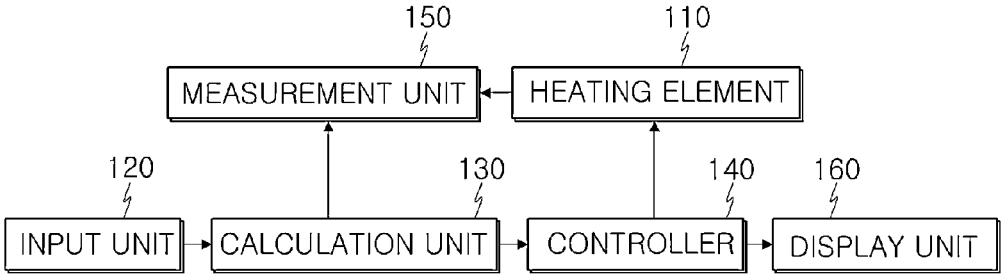
FIG. 1 illustrates a structure of an apparatus for controlling a heating element of an electric range according to an embodiment of the present invention.

FIG. 1 schematically illustrates an apparatus for controlling a heating element of an electric range according to an embodiment of the present invention.

Referring to FIG. 1, the apparatus for controlling a heating element of an electric range according to the current embodiment of the present invention may include a plurality of heating elements 110, an input unit 120, a calculation unit 130, a controller 140, a measurement unit 150, and a display unit 160.

An output adjustment value of each of heating elements 110 may be input by a user to the input unit 120. To this end, the input unit 120 has a shape of a touch pad, a touch screen, a dial or a button. The range of output power to be output by each heating element 110 may be classified according to stages, and the input unit 120 may be implemented in such a way that the user may select a level of output power corresponding to each stage. Here, the output adjustment value means a level of output power selected by the user.

The range of output power of each heating element 110 may be differently set. When the same distance between levels of output power of each heating element 110 is set, the number of stages of each heating element are differently classified, or when the number of stages of each heating element are equally classified, a distance between levels of output power of each heating element may be differently set. Alternatively, the output adjustment value may represent a level of output temperature selected by the user. That is, the input unit 120 may be implemented in such a way that output temperature can be set according to stages and the user may select a desired temperature.

The calculation unit 130 calculates the sum of output power of each heating element 110 corresponding to the output adjustment value input by the user.

The controller 140 controls output power of the heating element 110 corresponding to the output adjustment value input through the input unit 120. In this case, the controller 140 may compare the sum of output power calculated by the calculation unit 130 with a predetermined power limit and may linearly control output of each heating element 110 based on the result of comparison. Here, linear control of each heating element 110 may be not on/off control of power applied to each heating element 110 but may include linearly controlling output by dividing at least one of a current and a voltage applied to each heating element 110 into a plurality of stages from an initial value (generally, 0) to a maximum value and by rising or falling at least one of the current and the voltage in each stage or linearly controlling the temperature of each heating element 110 by measuring the temperature of each heating element 110 using the measurement unit 150 that will be described below, comparing the sum of output power with the power limit and limiting power.

In this case, if the sum of output power calculated by the calculation unit 130 exceeds the power limit, the controller 140 may divide a value that exceeds the power limit from the sum of output power according to the ratio of maximum output power of each heating element 110 that is currently driven among the plurality of heating elements 110 and may down control output of each heating element 110 that is currently driven corresponding to the divided value. For example, if it is assumed that maximum output power of the currently-driven heating element 110 is 1,000 W and 1,500 W, respectively and the predetermined power limit is 2,000 W, the ratio of maximum output power of the currently-driven heating element 110 is 2:3, and the value that exceeds the power limit is 500 W. Thus, the value that exceeds the power limit may be divided into 200 W and 300 W, and output power of each heating element 110 that is currently driven may be down controlled by the divided value.

Alternatively, if the sum of output power calculated by the calculation unit 130 exceeds the power limit, the controller 140 may equally divide the value that exceeds the power limit from the sum of output power into the number of heating elements that are currently driven among the plurality of heating elements 110 and may down control output of each heating element 110 that is currently driven corresponding to the divided value. For example, if it is assumed that the number of heating elements 110 that are currently driven among three heating elements 110 provided at the electric range is two and the value that exceeds the power limit from the sum of output power of each heating element 110 is 200 W, the controller 140 may equally divide the value of 200 W that exceeds the power limit into 2, the number of heating elements 110 that are currently driven and may down control output power of the heating element 110 that is currently driven by each divided value of 100 W.

Alternatively, if the sum of output power calculated by the calculation unit 130 exceeds the power limit, the controller 140 may divide the value that exceeds the power limit from the sum of output power based on the ratio of output power corresponding to the input output adjustment value with respect to maximum output power of each heating element 110 and may down control output of each heating element 110 corresponding to the divided value. For example, if it is assumed that maximum output power of three heating elements 110 provided at the electric range are 1,500 W, 1,200 W and 500 W and output power corresponding to the input output adjustment value are 1,000 W, 1,200 W and 0 W and the value that exceeds the power limit is 500 W, the ratio of output power corresponding to the input output adjustment value with respect to maximum output power of each heating element 110 is 2:3:0, output of each heating element 110 may be down controlled by 200 W, 300 W, and 0 W.

Also, if the sum of output power calculated by the calculation unit 130 exceeds the power limit, the controller 140 may set a control order of each heating element 110 according to the range of the value that exceeds the power limit from the sum of output power and may control output of each heating element 110 that is currently driven among the plurality of heating elements 110 to be sequentially reduced according to the set control order and the exceeding value. For example, when maximum output power of three heating elements A, B and C provided at the electric range is 1,500 W, 1,200 W and 500 W and the power limit is set as 2,500 W, if the range of the value that exceeds the power limit is within 300 W, the controller 140 may down control output power of the heating element A by the exceeding value, and if the range of the value that exceeds the power limit is between 300 to 500 W, the controller 140 may down control output power of the heating element A by 300 W and then may down control output power of the heating element B with respect to the remaining exceeding value, and if the range of the value that exceeds the power limit is between 500 to 700 W, the controller 140 may down control output power of the heating element A and the heating element B by 300 W and 200 W and then may down control output power of the heating element C with respect to the remaining exceeding value.

The measurement unit 150 may measure at least one of a current and a voltage applied to each heating element 110 or at least one of a current and a voltage applied to the electric range. That is, the measurement unit 150 may measure at least one of a current and a voltage generated by power applied to each heating element 110 by control performed by the controller 140 or may measure at least one of the entire current and the entire voltage applied to the electric range.

In this case, the calculation unit 130 may calculate real power consumption of each heating element 110 based on at least one of the current and the voltage measured by the measurement unit 150.

In this case, if the sum of real power consumption of each heating element 110 calculated by the calculation unit 130 is reduced over a range that is set with respect to the sum of output power, the controller 140 may up control output of each heating element 110 that is currently driven among the plurality of heating elements 110 based on a value that decreases compared to the sum of output power.

Although there is no change in the output adjustment value input through the input unit 120, real power consumption of each heating element 110 may be reduced due to disturbance, for example, an increase in a power usage amount of other electric apparatuses, a short circuit, etc. In this case, if the sum of real power consumption of each heating element 110 is reduced over a value that is set with respect to the sum of output power, the controller 140 may up control output of each heating element 110 based on the decreasing value. The same method as a method of down controlling each heating element 110 may be used as a method of up controlling each heating element 110.

Alternatively, the controller 140 may compare the sum of real power consumption calculated by the calculation unit 130 with the power limit and may up or down control output of each heating element 110 that is currently driven among the plurality of heating elements 110 according to the result of comparison.

For example, after the controller 140 determines that the sum of output power of each heating element 110 corresponding to the output adjustment value exceeds the power limit and down controls output power of each heating element 110, if the user turns off power of one heating element 110 or down controls an output level and the sum of real power consumption with respect to each heating element 110 is reduced over a predetermined value compared to the power limit, the controller 140 may up control output power of the remaining heating element 110 up to normal output power corresponding to the output adjustment value input by the user.

Alternatively, if the sum of real power consumption of each heating element 110 is different from the power limit over the set range, the controller 140 may divide the difference value according to the ratio of real power consumption of each heating element 110 that is currently driven among the plurality of heating elements 110 compared to the sum of real power consumption and may up or down control output of each heating element 110 corresponding to the divided value. For example, if it is assumed that maximum output power of the heating element A is 1,000 W and current real power consumption is 500 W and maximum output power of the heating element B is 1,500 W and current real power consumption is 1,000 W and exceeds the power limit by 500 W, the sum of real power consumption is 1,500 W and thus, the ratio of real power consumption with respect to the sum of real power consumption of each heating element 11l is (500/1,500):(1,000/1,500), i.e., 1:2. Thus, about 166 W corresponding to ⅓ of 500 W of the heating element A may be down controlled, and about 334 W corresponding to ⅔ of 500 W of the heating element B may be down controlled.

Alternatively, if the sum of real power consumption and the power limit are different from each other over the set range, the controller 140 may up or down control output of each heating element 110 that is currently driven among the plurality of heating elements 110 according to the same ratio or a time unit value until the difference value is within the set range. For example, as described above, if it is assumed that real power consumption of the heating elements A and B are 500 W and 1,000 W and exceed the power limit by 500 W, the controller 140 may down control output of each of the heating elements A and B according to the same output ratio (for example, a unit of 1%, 0.1%) or the same time unit (for example, a unit of 50 micro second per ½ cycle) until the sum of real power consumption does not exceed the power limit.

Alternatively, although the controller 140 determines that the sum of output power of each heating element 110 corresponding to the output adjustment value exceeds the power limit and down controls output power of each heating element 110 that is currently driven among the plurality of heating elements 110, if the sum of real power consumption of each heating element 110 still exceeds the power limit, the controller 140 may down control a value of real power consumption that exceeds the power limit in the same manner as the above-described method.

The display unit 160 may display an output adjustment value input to each heating element 110, output power corresponding to the output adjustment value, temperature and a control state. That is, if the user inputs the output adjustment value through the input unit 120, the display unit 160 may display the input output adjustment value, output power corresponding to the input output adjustment value, and temperature. Alternatively, if the controller 140 controls output power of each heating element 110 based on the sum of output power of each heating element 110 corresponding to the output adjustment value or the sum of real power consumption of each heating element 110, the display unit 160 may display whether to up or down control each heating element 110, a controlled output power amount, and a current power consumption amount. Alternatively, if at least one of the plurality of heating elements 110 is turned off, the display unit 160 may display temperature corresponding to the turned-off heating element 110, and if temperature of the heating element 110 is over a set value, the display unit 160 may display a message for notifying the user of the fact.

Figure 2:
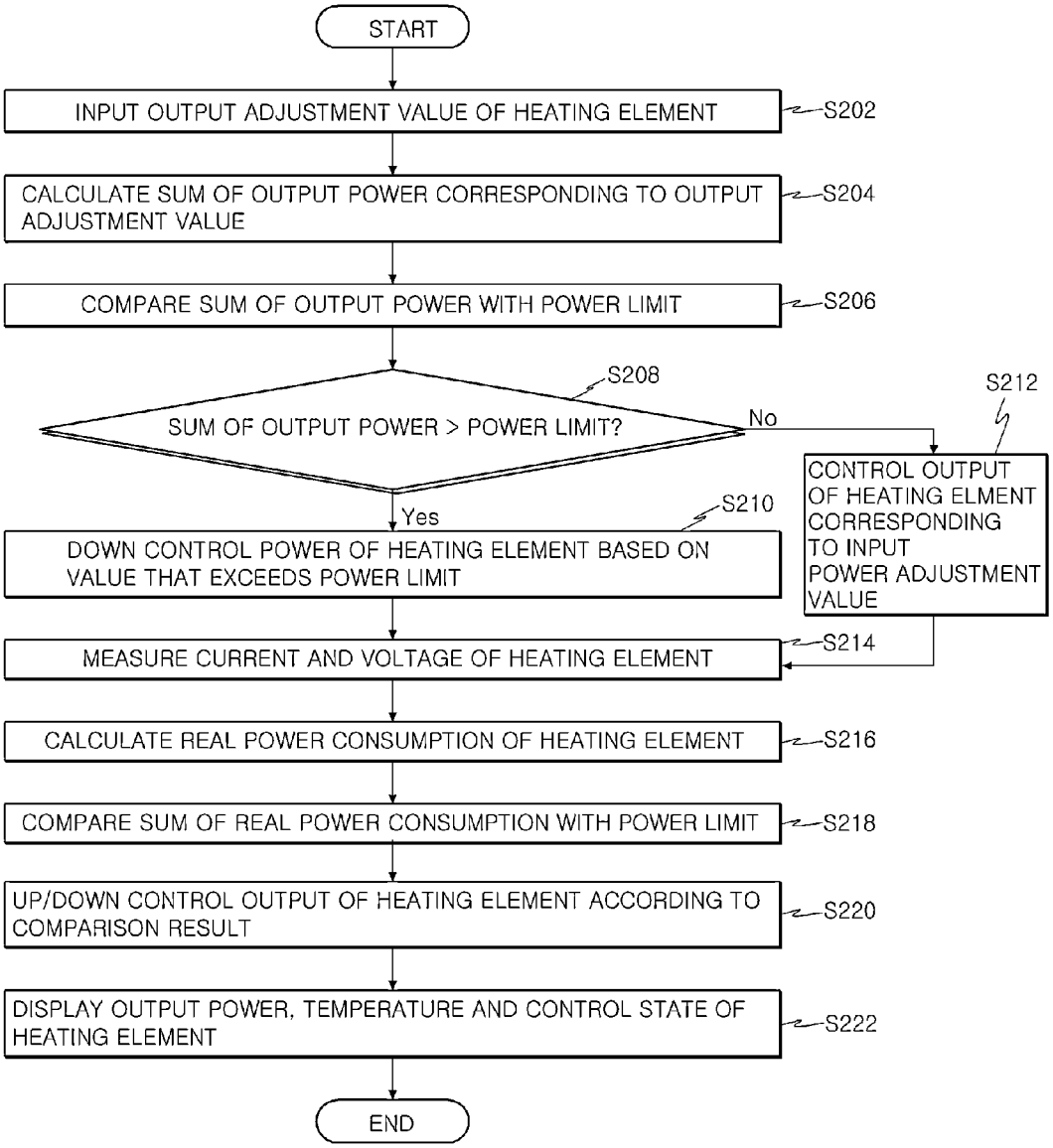
FIG. 2 is a flowchart illustrating a method of controlling a heating element of an electric range according to an embodiment of the present invention.

FIG. 2 is a flowchart illustrating a method of controlling a heating element of an electric range according to an embodiment of the present invention.

Referring to FIGS. 1 and 2, the input unit 120 may receive the output adjustment value of each heating element 110 from the user (S202).

The calculation unit 130 calculates the sum of output power of each heating element 110 corresponding to the output adjustment value input by the user (S204). In this case, the measurement unit 150 may detect the voltage applied to each heating element 110 and may calculate the sum of output power using a voltage compensation value caused by rise or fall of the voltage.

The controller 140 compares the sum of output power calculated by the calculation unit 130 with a predetermined power limit (S206), and if the sum of output power exceeds the power limit (S208), the controller 140 may linearly control output power of each heating element 110 that is currently driven based on a value that exceeds the power limit from the sum of output power (S210).

In this case, the controller 140 may control output power of each heating element 110 in a fine unit by dividing a waveform of alternating current (AC) power applied to the electric range. The AC power generally has a frequency of 50 Hz or 60 Hz. In Republic of Korea, 60 Hz is used as the AC power and thus, a ½ cycle of the AC power has a time interval of about 8.333 ms or an inclination angle from 0 to 180 degrees. Thus, the controller 140 may divide the time interval or inclination angle into 1/10, 1/100, and 1/1,000, and may adjust the applied current and/or voltage at each divided time interval or inclination angle, thereby controlling output power of each heating element 110.

Also, in order to apply output while reducing the occurrence of noise, the ½ cycle may not be partially divided but the whole ½ cycle may be as one output base so that the degree of power can be controlled with a balanced combination of an output waveform and an unoutput waveform according to the degree of output.

In addition, power can be controlled using a control unit, such as pulse width modulation (PWM) or time unit division control by rectifying an AC into a direct current (DC) using an output control device, such as a field effect transistor (FET), a diode for rectification and a condenser and removing ripple included in the rectified DC. This is because the method has large advantages in improvements in reactive power or power factor compared to the above method and has less noise than in other methods so that power can be precisely and stably controlled.

If the sum of output power is less than the power limit, the controller 130 may control each heating element 110 so that power corresponding to the output adjustment value input through the input unit 120 can be output (S212).

The measurement unit 150 may measure a current and a voltage of each heating element 110 (S214). That is, the measurement unit 150 may measure at least one of the current and the voltage caused by power applied to each heating element 110 by control performed by the controller 140 or may measure at least one of the current and the voltage applied to the electric range.

In this case, the calculation unit 130 may calculate real power consumption of each heating element 110 based on the current and the voltage measured by the measurement unit 150 (S216), and the controller 140 may compare the sum of each real power consumption calculated by the calculation unit 130 with the power limit (S218) and may control output of each heating element 110 according to the result of comparison (S220).

The display unit 160 may display the output adjustment value input to each heating element 110, output power, temperature, and a control state, which correspond to the output adjustment value (S222). That is, if the user inputs the output adjustment value using the input unit 120, the input output adjustment value and output power and temperature, which correspond to the output adjustment value. Also, when the controller 140 controls output power of each heating element 110 based on the sum of output power of each heating element 110 corresponding to the output adjustment value or the sum of real power consumption of each heating element 110, the display unit 160 may display whether to up or down control each heating element 110, a controlled output power amount, and a current power consumption amount. Alternatively, if at least one of the plurality of heating elements 110 is turned off, the display unit 160 may display temperature corresponding to the turned-off heating element 110, and if temperature of the heating element 110 is over a set value, the display unit 160 may display a message for notifying the user of the fact.

Table 1 shows resultant values when a method of controlling a heating element is applied to an electric range having four heating elements according to output stages. Here, heating elements having maximum output power of 1,100 W, 1,650 W, 950 W, and 1,100 W are used as each heating element (burner).

TABLE 1

| | Burner-1: 1,100 W | | | | Burner-2: 1,650 W | | | |
|---|---|---|---|---|---|---|---|---|
| Stage | Output value | Deviation value | Deviation variation | Power Consumption (W) | Output value | Deviation value | Deviation variation | Power Consumption (W) |
| 0 | 0 | 0 | | 0 W | 0 | 0 | | 0 W |
| 1 | 149 | 149 | 149 | 110 W | 149 | 149 | 149 | 175 W |
| 2 | 178 | 29 | −120 | 237 W | 178 | 29 | −120 | 345 W |
| 3 | 199 | 21 | −8 | 361 W | 199 | 21 | −8 | 543 W |
| 4 | 217 | 18 | −3 | 485 W | 217 | 18 | −3 | 731 W |
| 5 | 239 | 18 | 0 | 610 W | 235 | 18 | 0 | 911 W |
| 6 | 255 | 20 | 2 | 735 W | 255 | 20 | 2 | 1,093 W |
| 7 | 274 | 19 | −1 | 853 W | 270 | 19 | −5 | 1,237 W |
| 8 | 294 | 20 | 1 | 965 W | 293 | 23 | 8 | 1,469 W |
| 9 | 396 | 101 | 81 | 1,100 W | 395 | 102 | 79 | 1,650 W |

| | Burner-3: 950 W | | | | Burner-4: 1,100 W | | | |
|---|---|---|---|---|---|---|---|---|
| Stage | Output value | Deviation value | Deviation variation | Power Consumption (W) | Output value | Deviation value | Deviation variation | Power Consumption (W) |
| 0 | 0 | 0 | | 0 W | 0 | 0 | | 0 W |
| 1 | 149 | 149 | 149 | 93 W | 160 | 160 | 160 | 105 W |
| 2 | 179 | 30 | −119 | 201 W | 178 | 18 | −142 | 236 W |
| 3 | 200 | 21 | −9 | 306 W | 202 | 24 | 6 | 357 W |
| 4 | 218 | 18 | −3 | 419 W | 221 | 19 | −5 | 481 W |
| 5 | 235 | 17 | −1 | 531 W | 240 | 19 | 0 | 607 W |
| 6 | 255 | 20 | 3 | 633 W | 256 | 16 | −3 | 719 W |
| 7 | 276 | 21 | 1 | 736 W | 276 | 20 | 4 | 877 W |
| 8 | 297 | 21 | 0 | 838 W | 300 | 24 | 4 | 972 W |
| 9 | 395 | 99 | 77 | 950 W | 395 | 95 | 71 | 1,100 W |

Figure 3:
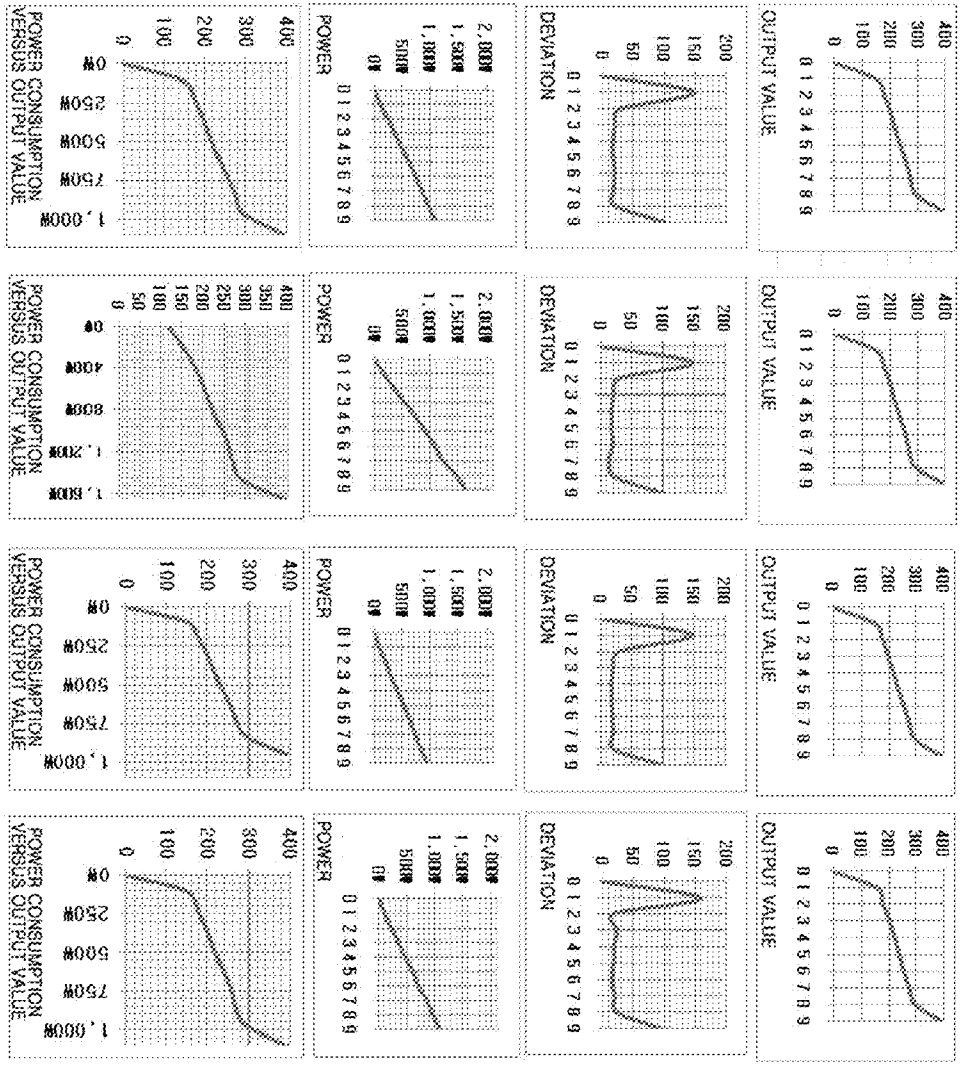
FIG. 3 illustrates examples of an output time of each level with respect to each heating element of an electric range, a deviation value between levels, output power of each level, and output power versus an output time.

Also, FIG. 3 illustrates examples of an output time of each level with respect to each heating element of an electric range, a deviation value between levels, output power of each level, and output power versus an output time.

Here, an output value that is a unit of resolving power of the entire power may be divided in a fine unit from several tens to several ten thousands unit or more and may be in a fine time unit or a unit of an output ratio (%) caused by waveform characteristics of an AC voltage/current. By implementing output resolving power in the fine unit in this way, the amount of power can be reduced and limited by a processor, such as proportional equal subtraction, in the fine unit when the sum of output power exceeds the power limit.

While the present invention has been particularly shown and described with reference to exemplary embodiments thereof, it will be understood by those of ordinary skill in the art that various changes in form and details may be made therein without departing from the spirit and scope of the present invention as defined by the following claims.

INDUSTRIAL APPLICABILITY

According to the present invention, when a plurality of heating elements are simultaneously used in an electric range including the plurality of heating elements, power can be continuously supplied to each of the plurality of heating elements without completely blocking power supplied to each heating element and power supplied to the electric range is controlled not to be over a limit.

The invention claimed is:

1. An apparatus for controlling a heating element of an electric range, the apparatus comprising:

a plurality of heating elements;

an input unit configured to input an output adjustment value for each of the plurality of heating elements by a user;

a calculation unit configured to calculate a sum of output power of each heating element corresponding to the output adjustment value input by the input unit;

a controller configured to compare the sum of output power calculated by the calculation unit with a predetermined power limit and linearly controls output of each heating element based on a result of comparison; and a measurement unit configured to measure at least one of a current and a voltage applied to each heating element after linearly controlling output of each heating element, wherein the calculation unit is configured to calculate real power consumption of each heating element based on the at least one of the current and the voltage measured by the measurement unit, wherein, when a sum of real power consumption of the plurality of heating elements is different from the predetermined power limit over a set range, the controller is configured to up or down control output of each heating element that is currently driven among the plurality of heating elements until the difference value is within the set range, and when the sum of real power consumption of the plurality of heating elements is reduced over the set range compared to the sum of output power, the controller is configured to up control output of each heating element that is currently driven among the plurality of heating elements based on a value reduced compared to the sum of output power.

2. The apparatus of claim 1, wherein, when the sum of real power consumption of the plurality of heating elements is different from the predetermined power limit over the set range, the controller is further configured to divide the difference value according to a ratio of real power consumption of each heating element that is currently driven among the plurality of heating elements compared to the sum of real power consumption and up or down control output of each heating element that is currently driven corresponding to the divided value.

3. The apparatus of claim 1, wherein, when the sum of real power consumption of the plurality of heating elements is different from the predetermined power limit over the set range, the controller is further configured to up and down control output of each heating element that is currently driven among the plurality of heating elements according to a ratio of real power consumption of each heating element or a time unit value until the difference value is within the set range.

4. The apparatus of claim 1, further comprising a measurement unit is configured to measure temperature of each heating element, wherein the controller compares the sum of output power with the predetermined power limit and linearly controls temperature of each heating element according to a result of comparison.

5. A method of controlling a heating element of an electric range, whereby outputs of a plurality of heating elements of the electric range are controlled, the method comprising:

inputting an output adjustment value for each of the plurality of heating elements from a user;

calculating a sum of output power of each heating element corresponding to the input output adjustment value;

comparing the calculated sum of output power with a predetermined power limit;

linearly controlling output of each heating element based on a result of comparison;

measuring at least one of a current and a voltage applied to each heating element; and calculating real power consumption of each heating element based on the at least one of the measured current and voltage, when the sum of real power consumption of the plurality of heating elements is different from the predetermined power limit over a set range, up or down controlling output of each heating element that is currently driven among the plurality of heating elements until the difference value is within the set range; and when the sum of real power consumption of the plurality of heating elements is reduced over the set range compared to the sum of output power, up controlling output of each heating element that is currently driven among the plurality of heating elements based on a value reduced compared to the sum of output power.

6. The method of claim 5, wherein the up or down controlling of output of each heating element comprises, when the sum of real power consumption of the plurality of heating elements is different from the predetermined power limit over the set range, dividing the difference value according to a ratio of real power consumption of each heating element that is currently driven among the plurality of heating elements compared to the sum of real power consumption and up or down controlling output of each heating element that is currently driven corresponding to the divided value.

7. The method of claim 5, wherein the up or down controlling of output of each heating element comprises, when the sum of real power consumption of the plurality of heating elements is different from the predetermined power limit over the set range, up or down controlling output of each heating element that is currently driven among the plurality of heating elements according to a ratio of real power consumption of each heating element or a time unit value until the difference value is within the set range.

8. The method of claim 5, further comprising:

measuring temperature of each heating element; and comparing the sum of output power with the predetermined power limit and linearly controlling temperature of each heating element according to a result of comparison.

* * * * *